United States Patent [19]

Dahl et al.

[11] 4,444,364

[45] Apr. 24, 1984

[54] SELF-ALIGNING CORE CHUCK

[75] Inventors: Carl B. Dahl, Rockton, Ill.; Roy A. Langdon, Beloit, Wis.

[73] Assignee: Beloit Corporation, Beloit, Wis.

[21] Appl. No.: 344,000

[22] Filed: Jan. 29, 1982

[51] Int. Cl.[3] ..... B65H 17/12

[52] U.S. Cl. ..... 242/68.3

[58] Field of Search ..... 242/68.3, 68.4, 68.7, 242/72 R, 72 B, 72.1, 73; 269/47; 279/2 R

[56] References Cited

U.S. PATENT DOCUMENTS

| | | | |
|---|---|---|---|
| 3,278,133 | 10/1966 | Froehlich | 242/68.3 |
| 3,474,982 | 10/1969 | Dodd | 242/68.4 |
| 3,606,188 | 9/1971 | Wagner | 242/68.3 |
| 4,327,301 | 4/1982 | Janson | 242/68.3 X |

*Primary Examiner*—Stuart S. Levy
*Assistant Examiner*—Scott J. Haugland
*Attorney, Agent, or Firm*—Hill, Van Santen, Steadman & Simpson

[57] ABSTRACT

A chuck assembly for insertion into the core of a paper windup roll to assure uniform winding and unwinding. The chuck assembly includes a shaft which has an axis coinciding with the desired axis of rotation of the core and bearing means which support the shaft for rotation therein. At the end of the shaft there is a stub shaft of reduced diameter which is received within a chuck having an axial bore therein. The bore is sufficiently larger in diameter than the diameter of the stub shaft to permit limited relative movement. The chuck further has a tapered wedge at its forward end which is arranged to fit tightly within the core and resilient spring means are provided to accommodate the relative movement between the stub shaft and the larger diameter bore in which it is located.

4 Claims, 3 Drawing Figures

SELF-ALIGNING CORE CHUCK

BACKGROUND OF THE INVENTION

1. Field of the Invention

This invention is in the field of core chucks for paper windup rolls specifically for use with power driven winding drums. The present invention provides a means for compensating for irregularities in the dimensions of the core to assure uniform winding and unwinding of the paper from the core.

2. Description of the Prior Art

In conventional drum winders for paper and the like, the roll of paper is placed on power driven winding drums and rotatably driven so that the paper is taken up on a winder core. It occasionally happens, however, that the core is not uniform in wall thickness between its inner and outer diameters. In that case, there is a tendency for the paper to be wound unevenly on the core because the core itself rotates eccentrically. Even a slight displacement from rotation along the true centerline can cause substantial vibration and problems of irregular winding in the relatively massive roll of paper being wound on the core.

SUMMARY OF THE INVENTION

The present invention provides an improved chuck assembly for insertion into a core of a paper windup roll which compensates for irregularities in the geometry of the core. The assembly includes a stabilizing shaft whose axis of rotation coincides with the desired axis of rotation of the core, i.e., the outer diameter of the core. The stabilizing shaft has a stub shaft of reduced diameter extending therefrom, and terminating in a threaded end portion. The chuck itself has a collar with an axial bore therein which receives a portion of the stub shaft and is sufficiently larger than the stub shaft to permit limited relative movement. A resilient connection is provided between the end of the stub shaft and the shaft itself by interposing a resilient means such as a Belleville spring between a locking means on the threaded portion and the portion of the stub shaft which is confined within the collar.

BRIEF DESCRIPTION OF THE DRAWINGS

A further description of the present invention will be made in conjunction with the attached sheet of drawings which illustrates a preferred embodiment.

DESCRIPTION OF THE PREFERRED EMBODIMENTS

Figure 1:
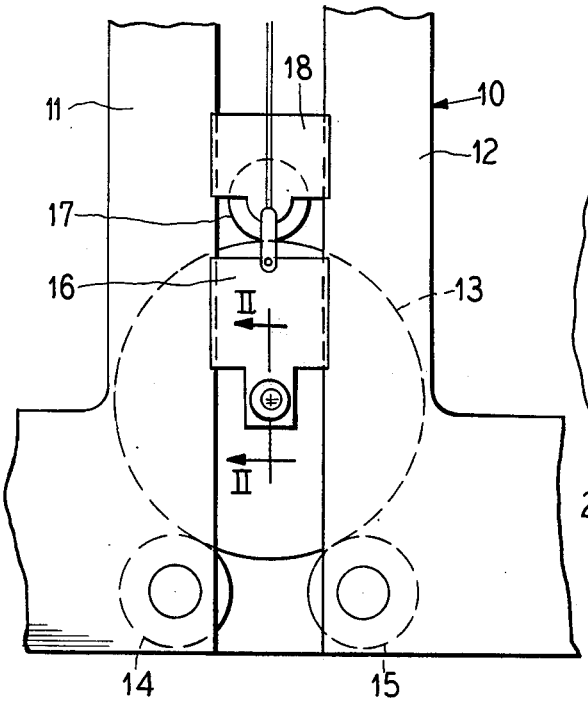
FIG. 1 is a fragmentary view in elevation of a drum winder assembly of the type with which the present invention is applicable.

In FIG. 1, reference numeral 10 indicates generally a paper winding mechanism including a pair of spaced frame members 11 and 12. A paper roll 13 is mounted for rotation within the frame, on a pair of positively driven winder drums 14 and 15. The core for the roll 13 is supported by a support 16 which is slidably received between the two frame members 11 and 12. A rider roll 17 carried by a support 18 maintains a predetermined pressure nip between the roll of paper and the winder rolls 14 and 15. The rider roll exerts a predetermined force on the roll of paper as it is being wound, the force decreasing as the roll of paper builds up. The rider roll 17 may be counterbalanced and may be removed from the paper roll when the weight of the paper itself gives adequate nip pressure. All of these features are common in drum winder assemblies and do not form a novel part of the present invention.

Figure 3:
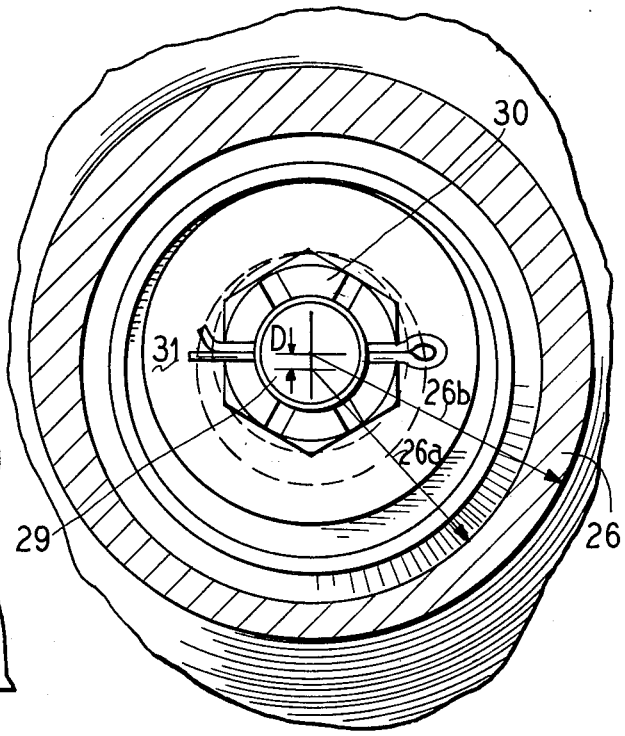
FIG. 3 is a cross-sectional view taken substantially along the line III—III of FIG. 2.
Figure 2:
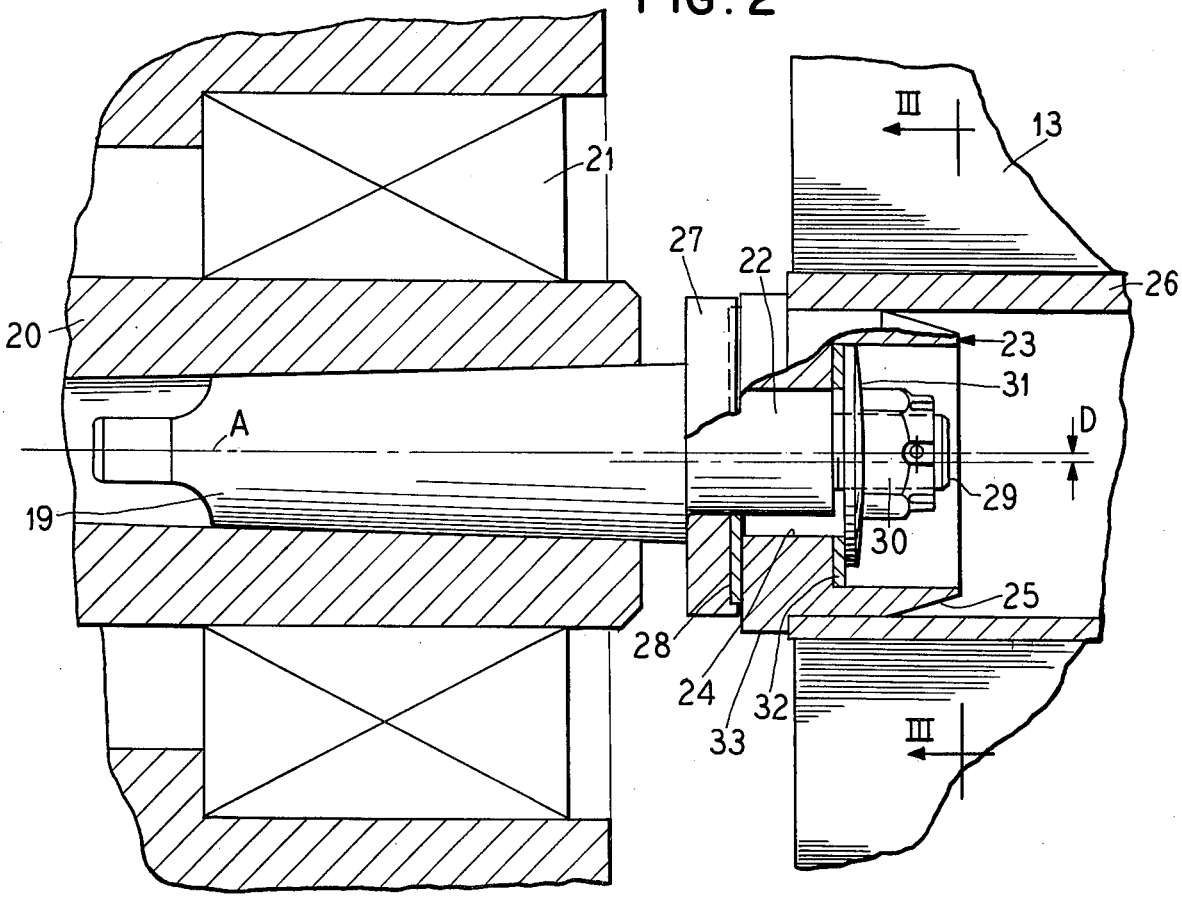
FIG. 2 is a cross-sectional view on an enlarged scale taken substantially along the line II—II of FIG. 1.

The improved chuck assembly of the present invention is best illustrated in FIGS. 2 and 3 of the drawings. As seen in those figures, the assembly includes a tapered shaft 19 which is received in wedged engagement in an internally tapered cylinder 20. The shaft 19 may, for example, have a No. 5 Morse taper. The cylindrical support 20 is arranged to be received in bearing means 21 for rotation along the axis A of the shaft. Bearing means 21 is rigidly secured within the frame 10.

Extending from the shaft 19 is a stub shaft 22. This stub shaft 22 is loosely received within a chuck assembly generally indicated at reference numeral 23 in the drawings. The chuck assembly includes an axial bore 24 which is sufficiently larger than the diameter of the stub shaft 22 to permit some limited relative movement. The chuck 23 has a tapered front end portion 25 which permits it to become wedged in the interior of a roll core 26. It also has a shoulder portion 33 which abuts the open end of the core 26 when the chuck is inserted therein. As shown in FIGS. 2 and 3, the roll core 26 is illustrated as having a wall thickness between the inner diameter *26a* and the outer diameter *26b* which is non-uniform. The non-uniformity has been exaggerated in both FIGS. 2 and 3 for purposes of illustration. As shown in FIG. 2, which illustrates the extreme condition, the stub shaft 22 is in close proximity to the upper surface of the bore 24, leaving a significant clearance between the lower part of the stub shaft and the lower surface of the bore 24. This results in a deviation D between the desired rotational axis which coincides with the axis of the shaft 22, and the actual axis of the inner diameter *26a*.

The stub shaft 22 extends through a ring 27, and the rear surface of the chuck 23 abuts against a thrust washer 28 which is confined between that surface and the ring 27. Thrust washer 28 should be made of a material that will permit the chuck to be offset easily, such as an oil impregnated material.

The stub shaft 22 has a reduced diameter threaded end portion 29. A hex castle nut 30 is received along the end portion 29 and serves to compress a Belleville spring 31 against a thrust washer 32, also composed of a material such as an oil impregnated mass. When the appropriate amount of tension has been placed on the Belleville spring 31, the castle nut 30 is locked in position by means of a cotter pin 33 passing through one of the radial slots in the castle nut 30 and through a corresponding bore in the stub shaft 22.

The chuck assembly of the present invention provides a self-aligning feature which compensates for irregularities in the wall thickness of the roll core. The resilient spring 31 permits the chuck to be secured to the stub shaft 22 without locking it rigidly relative to radial displacement. The low friction characteristics of the washers 28 and 32 permit the reaction of the support rollers 14 and 15 and the rider roll 17 to force the chuck radially as required to make the rotational center of the outside of the core coincide with the axis of the tapered shaft 19.

It should be evident that various modifications can be made to the described embodiments without departing from the scope of the present invention.

We claim as our invention:

1. A chuck assembly adapted for insertion into an open-ended core of a paper windup roll comprising:

a shaft having an axis coinciding with the desired axis of rotation of said core, bearing means supporting said shaft for rotation therein, a stub shaft forming an extension of said shaft and having a reduced diameter threaded end portion, a chuck having an axial bore into which said stub shaft extends, said axial bore being sufficiently larger than the diameter of said stub shaft so as to permit some limited relative movement therebetween, said chuck having a tapered end portion arranged to be received in wedged relation in the open end of said core, a ring through which a portion of said stub shaft extends, a first low friction thrust washer disposed between one face of said ring and the rearward end of said chuck, a resilient annular spring mounted over said threaded end portion, a second low friction thrust washer seating against one face of said annular spring, and tensioning means for applying an adjustable tension on said annular spring.

2. A chuck assembly according to claim 1 in which said annular spring is a Belleville spring.

3. A chuck assembly according to claim 1 in which both said thrust washers are composed of oil impregnated material.

4. A chuck assembly according to claim 1 wherein said tensioning means includes a nut threaded on said threaded end portion and locking means for locking said nut in a predetermined location on said threaded end portion.

* * * * *